US010966504B2

(12) United States Patent
Maelstaf et al.

(10) Patent No.: US 10,966,504 B2
(45) Date of Patent: Apr. 6, 2021

(54) DOUBLE SHELL POT FOR COSMETIC PRODUCT COMPRISING A MECHANICAL TENSIONING ELEMENT AND ASSEMBLY METHOD

(71) Applicant: L'OREAL, Paris (FR)

(72) Inventors: Luc Maelstaf, Bois Colombes (FR); Pierre Yves Paslier, Paris (FR)

(73) Assignee: L'OREAL, Paris (FR)

( * ) Notice: Subject to any disclaimer, the term of this patent is extended or adjusted under 35 U.S.C. 154(b) by 157 days.

(21) Appl. No.: 14/426,872

(22) PCT Filed: Sep. 10, 2013

(86) PCT No.: PCT/EP2013/068689
§ 371 (c)(1),
(2) Date: Mar. 10, 2015

(87) PCT Pub. No.: WO2014/037576
PCT Pub. Date: Mar. 13, 2014

(65) Prior Publication Data

US 2015/0230583 A1 Aug. 20, 2015

Related U.S. Application Data

(60) Provisional application No. 61/756,033, filed on Jan. 24, 2013.

(30) Foreign Application Priority Data

Sep. 10, 2012 (FR) ..... 1258477

(51) Int. Cl.
*A45D 40/00* (2006.01)
*A45D 40/18* (2006.01)
*B65D 25/10* (2006.01)

(52) U.S. Cl.
CPC ..... *A45D 40/0068* (2013.01); *A45D 40/18* (2013.01); *B65D 25/108* (2013.01); *Y10T 29/49872* (2015.01)

(58) Field of Classification Search
CPC ..... A45D 40/0068; B65D 25/108
(Continued)

(56) References Cited

U.S. PATENT DOCUMENTS 3,365,092 A * 1/1968 Blessing ..... A47J 41/0055 220/23.88
3,765,559 A * 10/1973 Sauey ..... B65D 81/3881 215/12.1
(Continued)

FOREIGN PATENT DOCUMENTS

DE 9303017 U1 4/1993
DE 202004011963 U1 12/2004
(Continued)

*Primary Examiner* — Stephen J Castellano
(74) *Attorney, Agent, or Firm* — Polsinelli PC

(57) ABSTRACT

This pot comprises a shell (9) comprising a bottom (15) so that the pot (1) can be placed on a surface (3), and a side part (17), and an insert (11) designed to contain the cosmetic product (2). The insert (11) is designed to be inserted into the shell (9) and fixed on it in an assembled position of the pot (1), in which the insert (11) and the shell (19) define an interstitial space (43) extending in front of the bottom (15) and the side part (17). The pot (1) also comprises a mechanical tensioning element (13) of the shell (9) that can be in a compressed position between the shell (9) and the insert (11) when the shell (9) and the insert (11) are in the assembled position.

9 Claims, 3 Drawing Sheets

(58) Field of Classification Search
USPC ..... 220/23.89, 920, 921, 918
See application file for complete search history.

(56) References Cited

U.S. PATENT DOCUMENTS

| | | | | |
|---|---|---|---|---|
| 3,847,494 | A * | 11/1974 | Franklin | A45D 40/0068 403/345 |
| 3,971,360 | A * | 7/1976 | Spoeth, Jr. | A47G 23/04 126/373.1 |
| 2008/0217344 | A1 | 9/2008 | Bodenbender | |
| 2010/0078440 | A1 * | 4/2010 | Bargan | F24J 1/00 220/592.2 |

FOREIGN PATENT DOCUMENTS

| | | |
|---|---|---|
| FR | 2071405 | 9/1971 |
| WO | WO-2007017209 A1 | 2/2007 |

* cited by examiner

DOUBLE SHELL POT FOR COSMETIC PRODUCT COMPRISING A MECHANICAL TENSIONING ELEMENT AND ASSEMBLY METHOD

CROSS REFERENCE TO RELATED APPLICATIONS

This application is a National Phase filing under 35 U.S.C. § 371 of PCT/EP2013/068689 filed on Sep. 10, 2013; and this application claims priority to Application No. 1258477 filed in France on Sep. 10, 2012; and this application claims the benefit of U.S. Provisional Application No. 61/756,033 filed on Jan. 24, 2013. The entire contents of each application are hereby incorporated by reference.

This invention relates to a pot for a cosmetic product comprising:

- a shell comprising a base so that the pot can be placed on a surface, and a side part, and
- an insert that will contain the cosmetic product, the insert being designed to be inserted into the shell and fixed on it in an assembled position of the pot, in which the insert and the shell define an interstitial space extending in front of the bottom and the side part.

The invention also relates to a method of assembling such a pot for a cosmetic product.

The cosmetic product contained in the pot may for example be a health care product, a keratin fiber coloring product, a cleaning product, a sun care product or a makeup product.

For the purposes of this invention, "cosmetic product" means particularly a product like that defined in the Nov. 30, 2009 EC Regulation No. 1222/2009 of the European Parliament and the Council relating to cosmetic products.

Single shell pots for cosmetic products, for example made of glass, are known in the state of the art. However, these glass pots are fairly heavy and have an impact on the environment related to their fabrication.

Double shell plastic pots have been developed to overcome these problems. For example the outer shell may be made of polyethylene terephthalate, while the inner shell or insert may for example be made of polypropylene that is more appropriate for contact with the cosmetic product. These pots are usually lighter in weight and have a higher capacity.

The interstitial space between the outer shell and the insert and particularly between the bottoms of the outer shell and the insert in these double shell pots is sufficiently large to prevent any contact between them in the assembled position. The attachment of the insert to the outer shell could be affected and even jeopardized if the bottom of the insert touches the outer shell in the assembled position due to fabrication tolerances on the height of these elements.

This cannot be acceptable considering the high production and assembly rate of these pots.

However, these pots give the user an impression of insufficient quality, in absolute terms and in comparison with the quality of single shell glass pots. Specifically, when the user places such a pot on a hard surface, the interstitial space may cause a hollow sound that can be unpleasant to some consumers.

Therefore one purpose of the invention is to disclose a pot for a cosmetic product comprising a shell and an insert and giving the user an impression of improved quality without any significant increase in the weight and environmental impact of the pot.

To achieve this, the purpose of the invention is a pot for a cosmetic product of the type described above in which the pot also comprises a mechanical tensioning element of the shell that can be in a compressed position between the shell and the insert when the shell and the insert are in the assembled position.

According to some particular embodiments, the pot for the cosmetic product may comprise one or several of the following characteristics, taken in isolation or in any technically possible combination:

- the tensioning element is fixed to either the shell or the insert, at least in the assembled position;
- the tensioning element extends between the insert and said bottom of the shell in the assembled position;
- the tensioning element is made in a single piece with the insert;
- the tensioning element is flared;
- the tensioning element in the assembled position bears on a contact line between the bottom and the side wall, the contact line being designed to be in contact with said surface;
- the tensioning element comprises a skirt extending from either the insert or the shell, the skirt bearing on the shell or the insert respectively in the assembled position;
- the skirt has a free continuous edge in contact over its entire length with the shell or the insert respectively in the assembled position;
- the skirt delimits at least one slit or a recessed part opening up into a free edge of the skirt;
- the tensioning element comprises at least one petal extending from the insert, each petal having a distal end supported on the shell in the assembled position;
- the tensioning element comprises a plurality of petals forming at least one corolla starting from the insert, the petals each having a distal end bearing on the shell in the assembled position;
- the tensioning element is capable of deforming during assembly of the pot from an unloaded rest position to the compressed position;
- the ratio of the mass of the tensioning element to the sum of the masses of the tensioning element and the insert is less than 8%.

The invention also relates to a method of assembling a pot for a cosmetic product like that described above, in which the insert is inserted into the shell and is then fixed on it in the assembled position, the tensioning element occupying a compressed position between the shell and the insert in the assembled position.

The invention will be better understood after reading the following description, given solely as an example and made with reference to the appended drawings in which.

Figure 2:
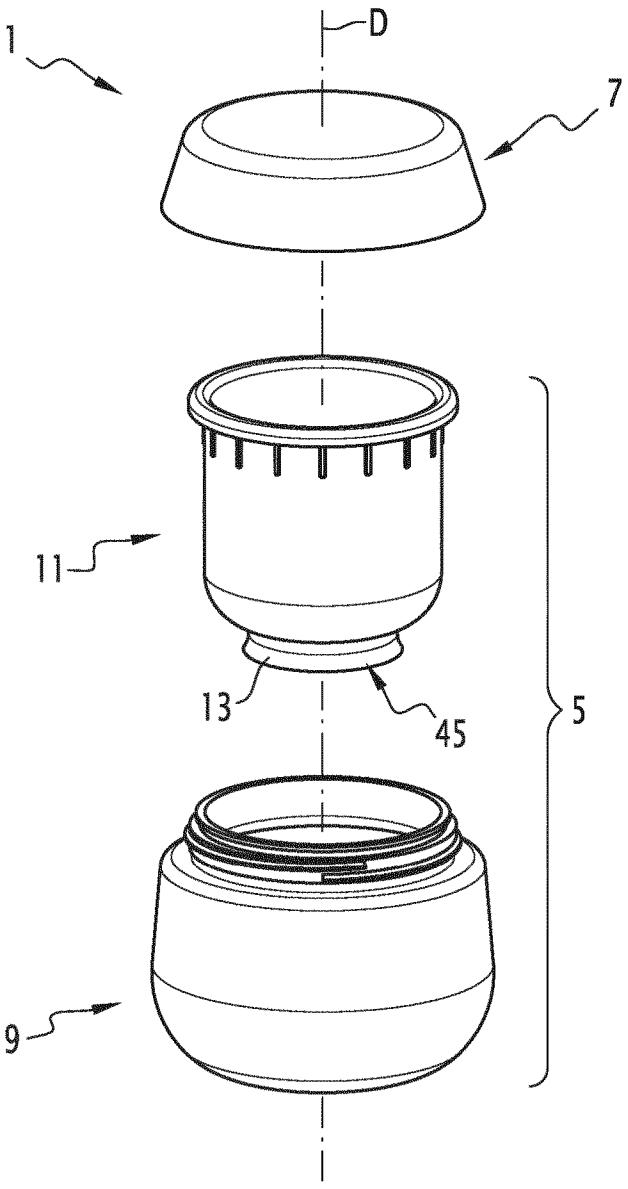
FIG. 2 is an exploded diagrammatic view or a view in the unassembled state according to a first embodiment of the pot shown in FIG. 1.
Figure 3:
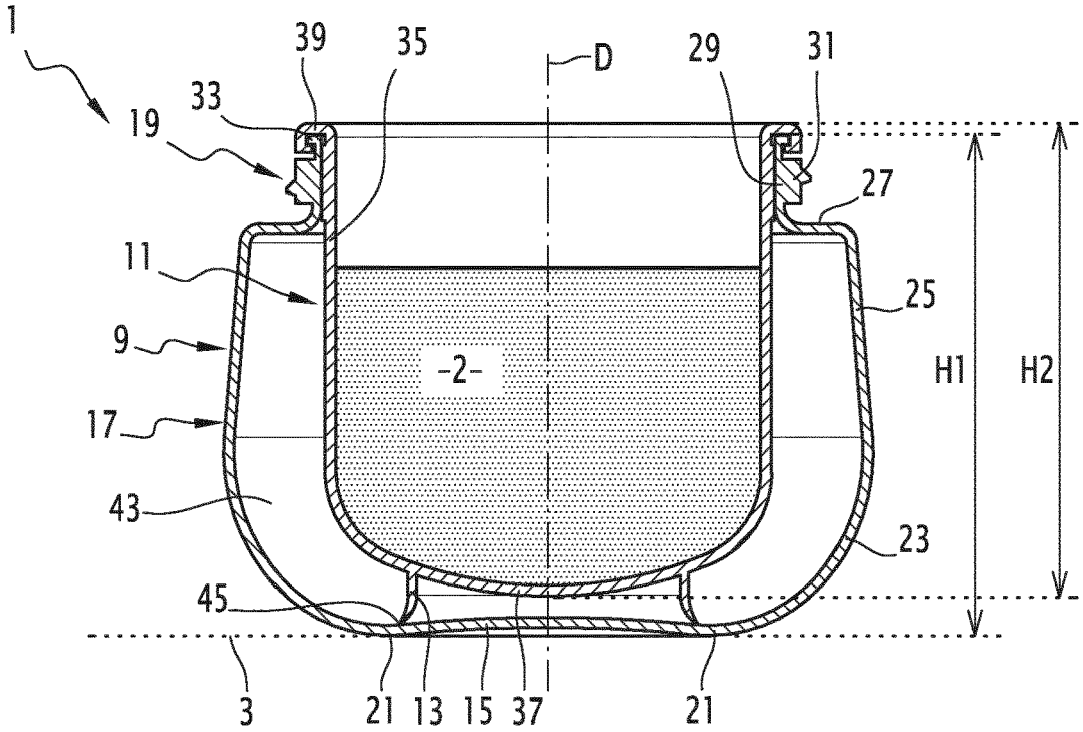
FIG. 3 is a vertical section through the pot shown in FIGS. 1 and 2, the plane of the section passing through an axis of revolution of the pot, without the lid.
Figure 4:
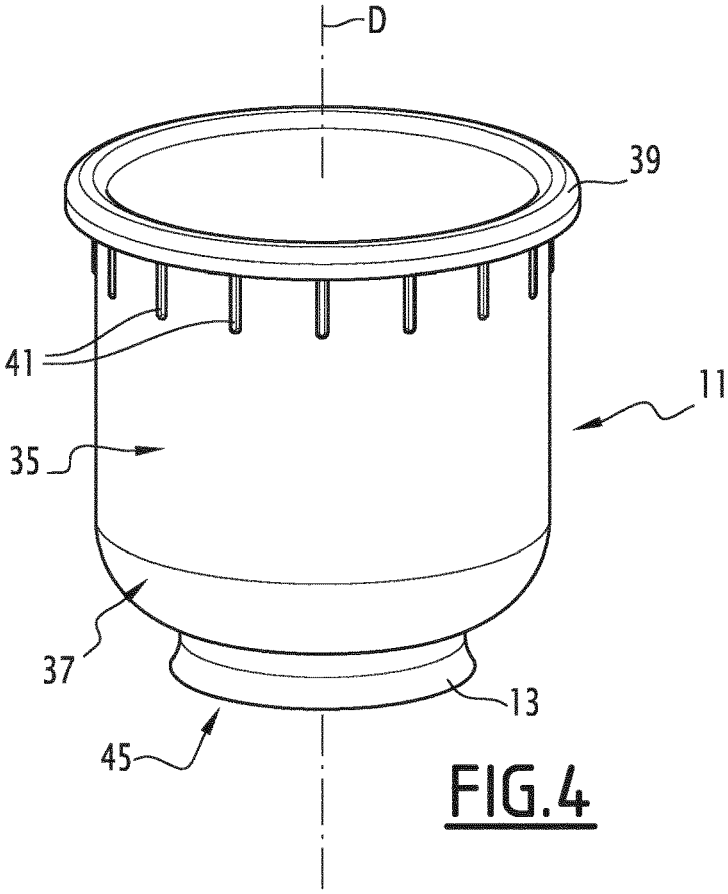
FIG. 4 is a diagrammatic perspective view of the insert of the pot shown in FIGS. 1 to 3.
Figure 5:
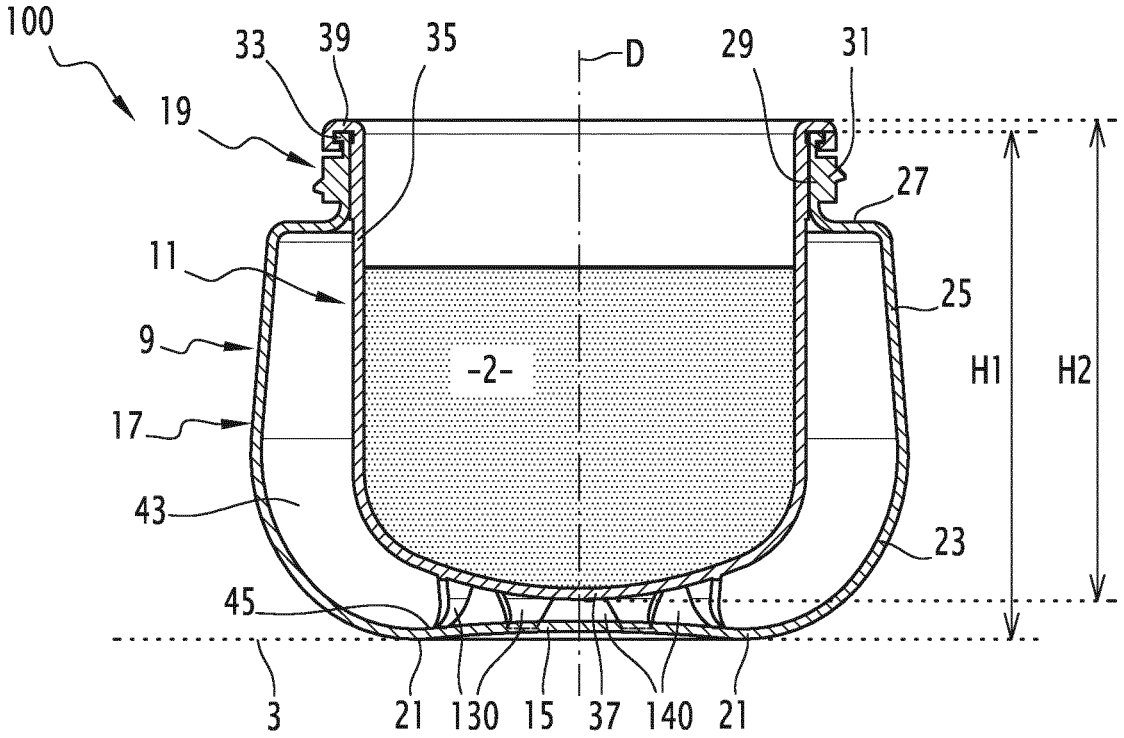
Figure 6:
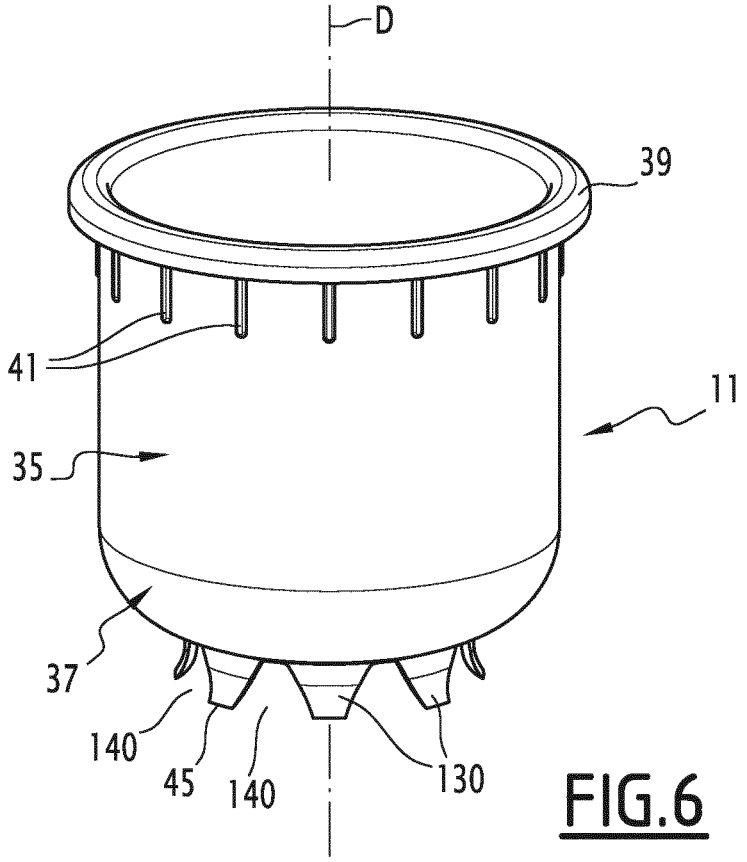

FIGS. 5 and 6 correspond to FIGS. 3 and 4 respectively, and illustrate a second embodiment of the pot shown in FIGS. 1 to 4.

Figure 1:
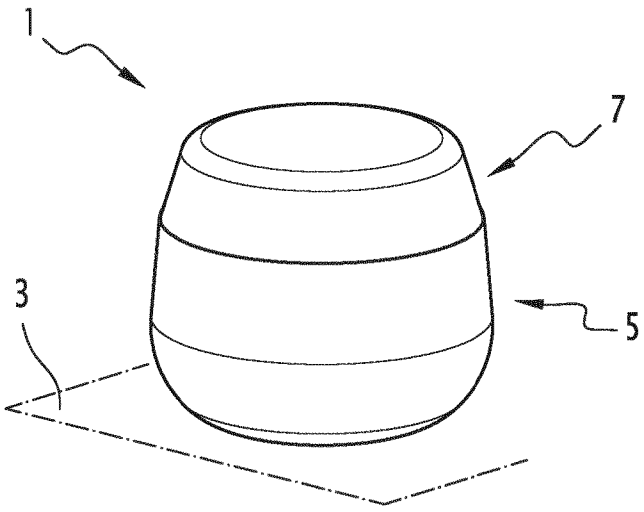
FIG. 1 shows a pot for a cosmetic product according to the invention in the assembled and closed state.

FIG. 1 shows a pot 1 for a cosmetic product 2 (visible in FIG. 3) according to the invention. The pot 1 will be placed on a surface 3, for example a shelf.

The pot 1 comprises a hollow body 5 and a lid 7 fixed onto the body 5, for example by screwing.

FIG. 2 shows the pot 1 in the unassembled state, in other words the body 5 is broken down into its component parts. The lid 7 is not screwed onto the body 5.

The body 5 comprises a shell 9 intended to rest on the surface 3, and an insert 11 or inner shell that will contain the cosmetic product 2. The insert 11 can be inserted into the shell 9 and fixed on it in an assembled position shown in FIG. 3.

In the example shown, the lid 7, the shell 9 and the insert 11 each have a general shape of revolution about a vertical axis D.

The pot 1 also comprises a mechanical tensioning element 13 of the shell 9 when the shell 9 and the insert 11 are in the assembled position.

The shell 9 is made of a thermoplastic material, advantageously polyethylene terephthalate, or metal. It is fabricated for example by injection blow molding. The shell 9 comprises a bottom 15 that will rest on the surface 3, a side part 17 projecting from the bottom 15 all around the axis D, and a neck 19 that is narrower than the side part 17, and through which the insert 11 will pass and that will be used to attach the lid 7 to the shell 9.

The bottom 15 is advantageously convex towards the inside of the pot 1. The contact of the bottom 15 with the surface 3 is made for example along the axis D along a contact line 21. The contact line 21 is approximately circular in the example shown.

The side part 17 extends between the bottom 15 and the neck 19 along the axis D. The side part 17 comprises for example a first convex region 23 extending from the contact line 21, and a second region 25 extending between the first region 23 and the neck 19 in continuity with the first region 23, as seen in a section on a vertical plane passing through the axis D.

For example, the neck 19 has a generally "L" shaped section.

The neck 19 comprises an approximately horizontal base 27 facing outwards, and an approximately vertical skirt 29. The skirt 29 will be in contact with the insert 11 in the assembled position.

The skirt 29 comprises an outer thread 31 for attachment of the lid 7 onto the shell 9 and an upper edge 33 onto which the insert 11 will click fit into the assembled position.

The insert 11 comprises an approximately cylindrical side wall 35, a convex bottom 37 closing the insert 11 towards the bottom, and an upper edge 39 that will click fit onto the upper edge 33 of the shell 9.

The insert 11 is made of a thermoplastic material or a metal. It may for example be made by injection.

As a variant, those skilled in the art may envisage other methods of fastening the insert 11 onto the shell 9, for example by screwing the insert 11 into the neck 19.

The insert 11 also advantageously comprises bushings 41 (FIG. 4) on the side part 35 that will be located facing the neck 19 in the assembled position.

The bushings 41 are advantageously approximately vertical and their vertical extension is approximately the same as the neck 19.

The height H2 of the insert 11 along the axis D is significantly less than the height H1 of the shell 9, to prevent contact with the bottom 15 of the shell 9. For example, the difference between H1 and H2 is between about 1 and 3 mm.

The insert delimits an inside volume that will contain the cosmetic product 2. For example, the volume may be between 10 ml and 500 ml. The volume advantageously contains a cosmetic product such as a health care product, a keratin fiber coloring product, a cleaning product, a sun care product or a makeup product.

In the assembled position (FIG. 3), the shell 9 and the insert 11 define an interstitial space 43 extending in front of the bottom 15 and the side part 17 of the shell 9.

For example, the interstitial space 43 has no through element from the shell 9 to the side part 35 of the insert 11. The interstitial space 43 also has no through element from the side part 17 of the shell 9 to the insert 11.

The tensioning element 13 extends within the interstitial space 43 between the insert 11 and the shell 9, for example between the bottom 37 of the insert 11 and the bottom 15 of the shell 9, advantageously between the bottom 37 of the insert and the contact line 21 of the shell 9.

For example, the tensioning element 13 is made in a single piece with the insert 11.

The tensioning element 13 is advantageously in the form of a skirt. This skirt preferably extends around the axis D at a distance from this axis D. For example it is a part of revolution about the axis D. The skirt also has a free edge 45 placed bearing on the shell 9 in the assembled position, as can be seen in FIG. 3.

The tensioning element 13 is advantageously flared at the bottom. For example, it comprises an approximately vertical upper part and a lower lip opening towards the bottom at a distance from the axis D and terminating at the free edge 45.

The free edge 45 may for example be continuous and in contact with the shell 9 over its entire length. The free edge 45 in the example shown is a circular wire.

The tensioning element 13 occupies a compressed position between the shell 9 and the insert 11 in the assembled position shown in FIG. 3 and occupies a rest position visible in FIG. 2 when it is unstressed before assembly.

The ratio of the mass of the tensioning element 13 to the sum of the masses of the tensioning element 13 and the insert 11 may for example be less than 8%, and preferably of the order of 5%. The tensioning element 13 accounts for a very moderate added material, for example of the order of 0.2 to 0.3 grams approximately for an approximately 6 g pot 1 with a content of 50 ml. Therefore the mass of the pot 1 is almost unchanged and there is practically no impact on the environment compared with a double shell pot without this element.

The assembly and operation of the pot 1 will now be described.

Pot 1 is assembled by placing the insert 11 in the shell 9. The insert 11 is then fixed on the shell 9 in the assembled position by click fitting the edge 39 of the insert 11 onto the edge 33 of the shell 9.

The tensioning element 13 deforms from its rest position to occupy its compressed position between the shell 9 and the insert 11 (FIG. 3).

The tensioning element 13 has some flexibility along the D axis capable of compensating for fabrication tolerances on the heights H1 and H2 of the shell 9 and the insert 11. These fabrication tolerances are usually of the order of 1%.

Due to its flexibility, the tensioning element 13 compensates for fabrication tolerances on the dimensions of the shell 9 and the insert 11.

In the rest position (FIG. 2), the tensioning element 13 is not stressed and is free in shape. In the example shown, the change from the rest position to the compressed position is done by elastic bending.

In the assembled position (FIG. 3), the tensioning element 13 applies a mechanical action both on the shell 9 and the insert 11. This mechanical action tensions the shell 9.

Due to the characteristics described above, when the user places the assembled pot on the surface 3, the pot 1 makes a duller and more solid sound than a similar pot without the tensioning element 13. This sound gives the user an impression of improved quality, like the sound made by a pot with a solid wall.

Action of the tensioning element 13 is particularly efficient when the tensioning element extends between the insert 11 and the bottom 15, and particularly when the tensioning element 13 bears on the contact line 21.

The fact that the tensioning element 13 is fixed on either the insert 11 or the shell 9 simplifies fabrication and assembly of the pot, particularly when the tensioning element 13 is made in a single piece with the insert 11.

The skirt shape, particularly flared, gives the required flexibility to the tensioning element 13, particularly along the axis D, and it is easy to strip.

We will now describe a pot for a cosmetic product 100 corresponding to a second embodiment of the invention, with reference to FIGS. 5 and 6.

The pot 100 comprises a shell 9 and an insert 11 similar to those of pot 1 shown in FIGS. 1 to 4 that will not be described again. The following only contains the differences between the pot 100 and the pot 1.

The pot 100 comprises a tensioning element 13 comprising petals 130. For example, the petals 130 are defined by recesses 140 starting from the surface of the insert 11 and opening up on the free edge 45 of the skirt.

The recesses 140 may for example be approximately trapezoidal in shape, the largest base of the trapezium being located on the free edge 45 of the skirt and the narrower base being located on the insert 11.

The pot 100 functions and is assembled in a manner similar to pot 1.

The recesses 140 increase the flexibility of the tensioning element 13.

As a variant, the recesses 140 may be smaller, and may even be reduced to simple slits (not shown) or even to a single slit.

According to other embodiments (not shown), the shell 9 and the insert 11 may have a general shape other than a shape of revolution, for example they may be square, rectangular or triangular in cross-section perpendicular to the axis D, with more or less rounded corners. In this case, the shape of the tensioning element 13 matches these shapes.

The invention claimed is:

1. A pot containing a cosmetic product, comprising:

a shell comprising a bottom so that the pot can be placed on a surface, and a side part, said shell defining an axis along which the side part extends, and an insert designed to contain the cosmetic product, the insert being designed to be inserted into the shell and fixed on it in an assembled position of the pot, in which the insert and the shell define an interstitial space, wherein the interstitial space extends between the insert and the bottom, and between the insert and the side part, in which the pot also comprises a mechanical tensioning element of the shell that is in a compressed position when the shell and the insert are in the assembled position, wherein in said compressed position the mechanical tensioning element extends through the interstitial space between the insert and the shell and is axially compressed along the axis of the shell by the insert and the shell, wherein the tensioning element is fixed to the insert, at least in the assembled position, wherein the tensioning element extends between the insert and said bottom of the shell in the assembled position, and wherein the tensioning element is flared, the tensioning element is made in a single piece with the insert, and wherein the insert is a single-walled insert.

2. A pot containing a cosmetic product, comprising:

a shell comprising a bottom so that the pot can be placed on a surface, and a side part, said shell defining an axis along which the side part extends, and an insert designed to contain the cosmetic product, the insert being designed to be inserted into the shell and fixed on it in an assembled position of the pot, in which the insert and the shell define an interstitial space, wherein the interstitial space extends between the insert and the bottom, and between the insert and the side part, in which the pot also comprises a mechanical tensioning element of the shell that is in a compressed position when the shell and the insert are in the assembled position, wherein in said compressed position the mechanical tensioning element extends through the interstitial space between the insert and the shell and is axially compressed along the axis of the shell by the insert and the shell, wherein the tensioning element is fixed to the insert, at least in the assembled position, wherein the tensioning element extends between the insert and said bottom of the shell in the assembled position, and wherein the tensioning element is flared, the tensioning element is made in a single piece with the insert, the ratio of the mass of the tensioning element to the sum of the masses of the tensioning element and the insert is less than 8%.

3. The pot according to claim 2, wherein the insert is a single-walled insert.

4. The pot according to claim 2, in which the tensioning element comprises a skirt extending from the insert, the skirt bearing on the shell in the assembled position.

5. The pot according to claim 4, in which the skirt has a free continuous edge in contact over its entire length with the insert in the assembled position.

6. The pot according to claim 4, in which the skirt delimits at least one slit or a recessed part opening up into a free edge of the skirt.

7. The pot according to claim 2, in which the tensioning element comprises at least one petal extending from the insert, each petal having a distal end supported on the shell in the assembled position.

8. The pot according to claim 7, in which the tensioning element comprises a plurality of petals forming at least one corolla starting from the insert, the petals each having a distal end bearing on the shell in the assembled position.

9. A pot, containing a cosmetic product, comprising:

a shell comprising a bottom so that the pot can be placed on a surface, and a side part, said shell defining an axis along which the side part extends, and an insert designed to contain the cosmetic product, the insert being designed to be inserted into the shell and fixed on it in an assembled position of the pot, in which the insert and the shell define an interstitial space, wherein the interstitial space extends between the insert and the bottom, and between the insert and the side part, in which the pot also comprises a mechanical tensioning element of the shell that is in a compressed position when the shell and the insert are in the assembled position, wherein in said compressed position the mechanical tensioning element extends through the interstitial space between the insert and the shell and is axially compressed along the axis of the shell by the insert and the shell, wherein the tensioning element is fixed to the insert, at least in the assembled position, wherein the tensioning element extends between the insert and said bottom of the shell in the assembled position, and wherein the tensioning element is flared, the tensioning element is made in a single piece with the insert; in which the tensioning element, in the assembled position extends between the insert and a contact line arranged between the bottom and the side part, the contact line being designed to be in contact with said surface and in which the ratio of the mass of the tensioning element to the sum of the masses of the tensioning element and the insert is less than 8%.

* * * * *